US006862991B2

(12) United States Patent
Schäfer

(10) Patent No.: US 6,862,991 B2
(45) Date of Patent: Mar. 8, 2005

(54) CYLINDER AND DEVICE FOR SECURING A FLEXIBLE PACKING ON THE CYLINDER

(75) Inventor: Karl Robert Schäfer, Rimpar (DE)

(73) Assignee: Koenig & Bauer Ajtuebgesekkscgaft, Wurzburg (DE)

( * ) Notice: Subject to any disclaimer, the term of this patent is extended or adjusted under 35 U.S.C. 154(b) by 0 days.

(21) Appl. No.: 10/416,536

(22) PCT Filed: Nov. 21, 2001

(86) PCT No.: PCT/DE01/04367

§ 371 (c)(1),
(2), (4) Date: May 28, 2003

(87) PCT Pub. No.: WO02/43962

PCT Pub. Date: Jun. 6, 2002

(65) Prior Publication Data

US 2004/0050276 A1 Mar. 18, 2004

(30) Foreign Application Priority Data

Nov. 28, 2000 (DE) ..... 100 58 996

(51) Int. Cl.[7] ..... B41F 27/12
(52) U.S. Cl. ..... 101/415.1; 101/378
(58) Field of Search ..... 101/415.1, 409, 101/378

(56) References Cited

U.S. PATENT DOCUMENTS

| | | | | |
|---|---|---|---|---|
| 3,359,899 A | * | 12/1967 | Luehrs | 101/415.1 |
| 4,938,134 A | * | 7/1990 | Dorsam et al. | 101/415.1 |
| 5,069,127 A | | 12/1991 | Iijima et al. | |
| 5,359,933 A | * | 11/1994 | Blaser et al. | 101/415.1 |
| 5,396,843 A | | 3/1995 | Durr | |
| 5,402,722 A | * | 4/1995 | Schneider et al. | 101/415.1 |
| 5,483,891 A | | 1/1996 | Reichel | |
| 5,709,149 A | | 1/1998 | Weber | |
| 5,738,012 A | | 4/1998 | Metrope | |
| 5,778,786 A | | 7/1998 | Metrope | |
| 6,382,103 B1 | | 5/2002 | Rauh | |
| 6,543,358 B1 | | 4/2003 | Schneider et al. | |
| 6,557,469 B1 | | 5/2003 | Schneider et al. | |

FOREIGN PATENT DOCUMENTS

| | | | |
|---|---|---|---|
| DD | 261 764 A1 | | 11/1988 |
| DE | 43 35 140 C1 | | 2/1995 |
| DE | 195 07 368 C1 | | 3/1996 |
| DE | 196 00 071 C1 | | 5/1997 |
| DE | 197 57 895 A1 | | 7/1999 |
| DE | 199 24 784 A1 | | 12/2000 |
| DE | 199 24 785 A1 | | 12/2000 |
| EP | 0 713 770 A1 | | 5/1996 |
| EP | 0 755 785 A1 | | 1/1997 |
| EP | 0 606 604 B1 | | 7/1997 |
| EP | 0 713 770 B1 | | 5/1998 |
| GB | 2 206 534 | * | 1/1989 |
| WO | WO 89/11393 | | 11/1989 |

* cited by examiner

*Primary Examiner*—Leslie J. Evanisko
(74) *Attorney, Agent, or Firm*—Jones, Tullar & Cooper, P.C.

(57) ABSTRACT

A device is provided for securing at least one leading end and at least one trailing end of at least one packing on a cylinder of a rotary printing machine. The cylinder is provided with an axially extending channel. The leading end of the packing is bent at an acute angle and can fit into a nose configurement between the channel wall and the cylinder's peripheral surface. A securement element, that has a one-armed lever, is located in the channel and secures the trailing end by clamping it using a spring force. The channel has only one securing device in the peripheral direction.

37 Claims, 3 Drawing Sheets

CYLINDER AND DEVICE FOR SECURING A FLEXIBLE PACKING ON THE CYLINDER

FIELD OF THE INVENTION

The present invention is directed to a device for securing a packing on a cylinder of a rotary printing press. An axially extending channel in the cylinder has a first wall that defines a packing leading end securement. A pivotable lever in the channel forms the securement for the trailing end of the packing.

BACKGROUND OF THE INVENTION

A tensioning device for printing formes on a cylinder is known from EP 0 713 770 B1. A hook-shaped end of a printing forme is suspended in a hook-shaped end of a leaf spring and, by use of the latter, is tensioned tangentially in respect to the surface area in the area of the channel. Release of the forme end is provided by use of a hose which can be charged with a pressure medium.

EP 0 606 604 B1 also discloses a tensioning device for a printing plate with a bent-off end, which plate end is suspended in a hook-shaped tensioning strip, which is prestressed by a torsion bar spring and, by use of the former, is tensioned in the area of the channel tangentially in relation to the surface area. Here, too, the release is provided by a hose which can be charged with a pressure medium.

DE 43 35 140 C1 shows a tensioning device for a printing plate. Two leaf springs, respectively grasping a leading and a trailing end of the plate, are fastened on a rotatable spindle.

A clamping device is known from later published DE 199 24 785 A1. A leading and a trailing end of a plate can be clamped by a two-armed lever seated in the interior of the channel.

DD 261 764 A1 discloses a clamping and tensioning device. A shaft is arranged in a hollow shaft for the purpose of the independent clamping of a leading end and for the clamping/tensioning of a trailing end of a packing. At least one strip is attached to the shaft, as well as to the hollow shaft, and acts together with the ends of the packing.

U.S. Pat. No. 5,069,127 shows tensioning devices, which can be actuated independently from each other, for packings arranged next to each other. This is done by shafts extending coaxially in respect to each other, which are arranged in the cylinder interior and which are operated from the outside.

An actuating device which can be charged by a pressure medium is disclosed in EP 0 755 785 A1. This device is arranged outside of a tensioning channel and drives a shaft which supports a lever.

The last mentioned devices for clamping require an increased production outlay. In the installed state, they also require a structural space which assures the reception of the two-arm lever, or of the shafts and strips.

SUMMARY OF THE INVENTION

The object of the present invention is directed to providing devices for securing a packing on a cylinder.

In accordance with the present invention, this object is attained by the provision of at least one axially extending channel in the cylinder. A leading bent-over end of the plate-or packing to be secured to the cylinder engages a protrusion that is formed by a first channel wall. A securing device, which has a pivotable one-armed lever and uses a spring to place the lever in a clamping position against the plate or packing trailing end is placed in the channel. Only this single securement device is located in the cylinder channel. An actuating device, that can be charged with a fluid under pressure, is usable to release the securement device. A plurality of independently operable securement devices and associated actuating devices can be arranged adjacent each other in the axially extending channel.

The advantages to be obtained by the present invention consist, in particular, in that a dependable securing, which can be automated, of a packing, such as, for example, a printing forme or a printing blanket, on the surface area of a cylinder, for example a forme or transfer cylinder of a rotary printing press, can take place. It, is possible, at the same time, to keep the width of a gap in the surface area of the cylinder for receiving the ends of the packing very small.

The gap can be kept very small since there is no tangential tensioning of one of the plate ends. Such tangential tensioning requires space for a spring or for a tensioning path.

In this connection, it is also particularly advantageous that the packing rests on the surface area of the cylinder and in the area of its edge. Positive tangential tensioning partly requires an area of the packing which is not underlaid by the cylinder surface area, which results in a high danger of breaking in the course of a roll-off against a further cylinder, in particular against a cylinder without a channel, for example when using so-called sleeves.

The positive suspension of the leading end of the packing or forme onto an acutely angled protrusion formed in the cylinder by the geometry of the channel, and by the cylinder surface area is advantageous in respect to a structurally simple device, which can be automated. In this way, radial and tangential forces at the packing are absorbed without a clamping device for the leading end, provided the trailing end is fixed in respect to its tangential movement.

In an advantageous embodiment of the present invention, the fixation of the trailing end is provided by the positive attachment of the trailing end, which is beveled, or bent at almost right angles, to the cylinder in the tangential direction. A securing element arranged in the channel therefore need not compensate for tangential forces, but only needs to counteract radial forces stemming from the centrifugal force and possibly from a deformation-caused restoring force of the packing. Thus, less force needs to be applied to such a frictional connection.

The provision of the packing with a trailing end which is beveled almost at right-angles, but at least between 60° and 100°, and in particular between 85° and 95°, is advantageous also because it is easier to automate. Following the suspension of the leading end to the cylinder, a roll-up of the packing on the cylinder, in the direction of cylinder rotation, if needed, by using pressure rollers, can take place. In the course of this, the trailing end is pushed into the channel in a simple way.

The embodiment of the securing device in accordance with the present invention, wherein an actuating device need only be employed for changing the packing, is advantageous in terms of dependability and of use of the operating medium. Clamping of the plate trailing end takes place by use of a spring force without the activation of a device or of a pressure medium, even in case of an interference.

The opening of the device for securing a packing in accordance with the present invention is performed in an advantageous embodiment by use of a reversibly deformable hollow body, which is charged with a pressure medium.

The arrangement of a one-armed lever saves installation space in contrast to a two-armed lever of the same achievable moment. In an advantageous configuration, a spring acts almost perpendicularly with respect to the beveled trailing plate or packing end which is to be clamped. With an arrangement of pressure springs, the arrangement of the lever and springs is advantageous in view of the efficiency of the springs. The mean force application point of the spring on the lever is located at least at half of the distance of the lever from the pivot axis to the clamping point. This makes possible a reduced space requirement, while providing a sufficient lever effect at the same time.

In one embodiment of the device in accordance with the present invention the lever, spring, actuating device, as well as possibly any required delivery lines for the pressure medium, are arranged almost completely inside a tube-shaped base body. This allows a simple and cost-effective production of the cylinder and of the channel, which can be embodied as a bore in the cylinder.

The arrangement of several independent, individually removable base bodies next to each other in the axial direction is very advantageous in terms of interchangeability and maintenance. In this way, the removal of the entire cylinder, to remove the base bodies, can be avoided.

In an embodiment of the present invention, only one lever, which is, for example, configured as a strip of sheet metal and which has springs on one side, and a hose, which can be charged with a pressure medium, are inserted into the channel. This embodiment has particular advantages with regard to mounting and to production outlay.

BRIEF DESCRIPTION OF THE DRAWINGS

Preferred embodiments of the present invention are represented in the drawings and will be described in greater detail in what follows.

DESCRIPTION OF THE PREFERRED EMBODIMENTS

Figure 1:
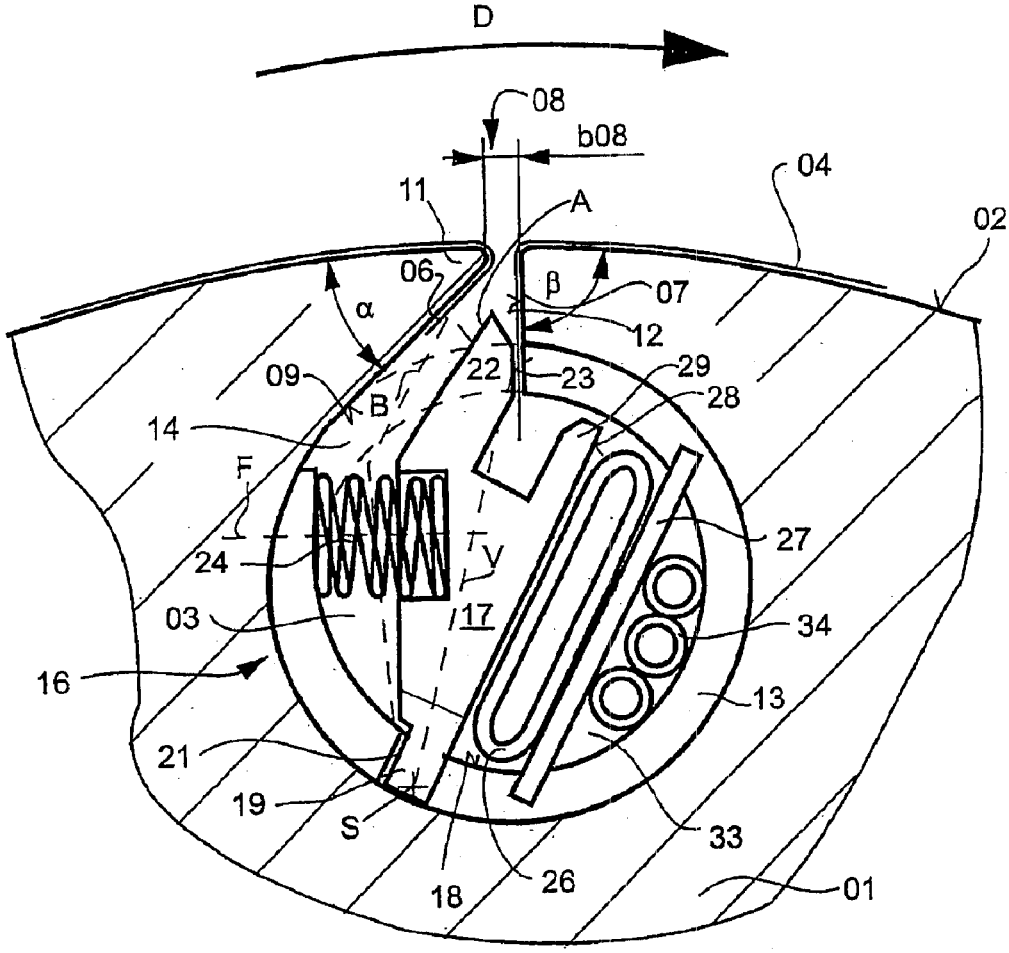
FIG. 1 is a cross-section through a first preferred embodiment of a device for securing a packing, and is taken transversely to the cylinder axis.

A cylinder 01 of a rotary printing press, for example a forme cylinder 01 or a transfer cylinder 01 of a rotary printing press in accordance with the present invention, is shown in FIG. 1 and has adjacent its surface 02 at least one channel 03, which channel 03 extends into the interior of the cylinder 01 and which also extends in the axial direction of the cylinder 01. Channel 03 is intended for use for securing at least one packing 04, for example a printing forme 04, or a rubber blanket 04 onto the surface 02 of cylinder 01. Two beveled packing ends or edges 06, 07 extend into the channel 03. A first packing end 06 is leading in respect to a cylinder rotational direction D, and a second end 07 of the packing 04, is trailing. Alternatively, a leading end 06 and a trailing end 07 of two packings 04 adjoining each other in the circumferential direction can be received in the cylinder channel 03.

In the area of the cylinder surface area 02, the channel 03 has an opening 08, for example a gap 08, of a small width b08 in the circumferential direction. This narrow gap 08 may have a width b08 of, for example, less than 5 mm, and in particular of less than 3 mm.

A first cylinder channel or groove wall 09, that is assigned to receive the packing leading end 06, extends at an acute angle, in particular at an angle $\alpha$ of between 30° and 60°, in the direction toward the surface area 02 and forms a protrusion 11 in cooperation with the cylinder surface area 02, as seen in FIG. 1. A second cylinder channel wall 12 extends approximately radially from the cylinder surface area 02 into the interior of the cylinder 01 and forms an approximately right angle $\beta$, of, for example between 85° and 95°, with the cylinder surface area 02.

The channel 03 widens as it extends radially toward the interior of the cylinder 01, for example forming a circular cross section, which, in an advantageous manner, is embodied as an axially extending bore. The channel 03, however, can also widen in other cross-sectional shapes, for example having a rectangular-shaped cross section.

A base body 13 is arranged in the cylinder channel 03, in particular in the area of the bore, which base body 13, in the preferred embodiment of FIG. 1, has a circular cross section of a size corresponding to the bore. On its circumference, the base body 13, which may be, for example, a tube 13, has at least one axially extending aperture 14, which faces the opening 08 of the channel 03. Several apertures 14, which lie next to each other in the axial direction, can also be arranged in a base body 13.

In an advantageous embodiment of the present invention, the length of the base body 13 is less than 100 mm, and in particular is between 50 and 80 mm, so that several base bodies 13, which are arranged in the channel 03 next to each other, correspond to the width of the packing 04. If several, for example if two, four, or even six packings 04 are arranged next to each other in the axial direction on the cylinder 01, the channel 03 has at least a corresponding number of base bodies 13, which are arranged next to each other and which can be individually taken out of the channel 03. Several such base bodies 13 can again be arranged for the width of each packing 04. In its interior, the base body 13 has a plate or packing trailing end securing device, generally at 16.

In the first preferred embodiment depicted in FIG. 1, the packing trailing end securing device 16 has a one-armed, largely rigid lever 17, which is seated, pivotable around a pivot axis S, in the area of a wall 18 of the base body 13, which is located opposite the opening 08 of the channel 03. The pivot axis S, which is understood to be imaginary in the first preferred embodiment of the present invention, as depicted in FIG. 1, is stationary with respect to the cylinder 01 during pivoting of lever 17. Seating of the lever 17 in base body 13 takes place, for example by use of an axially extending lever rib 19, or by several bolts 19 arranged next to each other in the axial direction, and located at an end of the lever 17 pointing into the interior of the cylinder 01. This rib 19, or the bolts 19, are seated in a corresponding number of base body wall cutouts 21 in the wall 18 of base body 13, so that a free end 22 of the lever 17 can be pivoted with respect to the circumferential direction of the cylinder 01.

The lever 17 has a length so that in a first position A, such as for example a lever clamped position A, shown in solid lines in FIG. 1, a lever clamping face 23 on the free end 22 of the lever 17 can work together at least with a wall of the aperture 14 in the base body 03 as an abutment. In another advantageous embodiment, which is not specifically depicted, the length of the lever 17 can be selected to be such that the clamping face 23 works together with the second cylinder channel wall 12 as the abutment.

A spring 24, in particular a pressure spring 24, is arranged between the lever 17 and the wall of the base body 13 situated adjacent to the leading packing end 06 as a further component of the packing trailing end securing device 16. In an advantageous manner, an effective direction F, in this case equivalent to a center axis F of the pressure spring 24 extends approximately perpendicularly, with a variance of ±15°, with respect to the second cylinder channel wall 12, wherein spring 24 is arranged in the base body 13 in such a way that the effective direction F and a connecting line V extending between the pivot axis S and the clamping face 23 intersect at a distance from the pivot axis S of at least half the length of this connecting line V. The connecting line V corresponds to an effective lever length of the lever 17. Thus a substantial clamping force is possible, together with an extremely space-saving construction.

The packing trailing end securing device can be actuated to release the plate trailing end 07 by a pressure medium, such as a reversibly deformable hollow body 26, for example a hose 26, which can be charged with a pressure medium. Hose 26, is arranged on the base body 13. This hose 26 is supported either against the wall 18 of the base body 13 arranged in the direction of cylinder rotation D, or against an abutment 27, for example a wall 27 extending axially and chord-like in the base body 13. On its side facing away from the wall 27, the hose 26 works together with a face 28 of the lever 17 facing away from the spring 24. In a different embodiment, a lifting piston, which can be actuated by a pressure medium, can be arranged in place of the hose 26.

In a preferred manner, the possible lift of the hose 26 in the direction toward the face 28 of the lever 17 is of such a dimension that, when the hose 26 is charged with compressed air, the lever 17 is in a second position B, shown in dashed lines in FIG. 1 for example a packing leading end securing position B, wherein the free end 22 of the lever 17 is placed against the packing leading end 06 and secures it.

In a preferred embodiment of the present invention, the lever 17 is fork-like in shape in an area remote from the lever pivot axis S. The trailing end 07 of the packing 04 can be inserted between lever free end 22 provided with the clamping face 23, and a lever second free end 29, provided with the lever face 28, which lever face 28 acts together with the hose 26.

To secure the base body 13 against twisting in the channel 03, a screw or a bolt, which is not specifically represented, can be arranged in the channel 03, which screw or bolt engages a corresponding not represented axially extending groove in the wall 18 of the base body 13. However, in place of this screw or bolt, it is also possible to arrange a spring, for example a leaf spring, which acts as a twisting preventer and at the same time secures the base body 13 against possibly existing play between the base body 13 and the channel 03.

One or several pressure medium delivery devices 34, such as, for example lines 34 or conduits 34, for the pressure medium can be provided in a hollow space 33 between the chord-like extending wall 27 and the wall 18 of the base body 13.

In a preferred embodiment of the device for securing a packing, and in particular for cylinders 01 with two, four, or even six packings 04 arranged next to each other in the axial direction, the corresponding number of independent pressure medium delivery devices 34 and hollow bodies 26 is provided. In connection with so-called double-, or even triple-width cylinders 01, i.e. cylinders 01 of a width corresponding to at least four, or even six adjacently arranged printing formes 04, it is possible to arrange one or two, or three delivery devices 34 and associated hollow bodies 26, for example for two or three rubber blankets 04 arranged next to each other on a double-width or a triple-width transfer cylinder 01, or four or six delivery devices 34, for example for four or six printing formes 04 next to each other on a double-width or triple-width forme cylinder 01, next to each other. Because of this configuration, the single or paired change of packings 04 on the respectively single-, double- or triple-width cylinder 01 is possible.

Several cylinder channels 03, each with several base bodies 13 and with associated packing trailing end securing devices 16, can be arranged spaced in the circumferential direction of the cylinder 01. In this case, a leading end 06 of a first packing 04 and a trailing end 07 of a second packing 04, which is adjacent in the circumferential direction, for example, to the first packing 04, are maintained in the same channel 03.

The device for securing a packing in accordance with the present invention is suitable for securing printing formes 04 on forme cylinders 01, as well as for securing rubber blankets 04 on transfer cylinders 01. However, in the latter case, the rubber blanket 04 must have rigid, appropriately beveled or angled ends 06, 07. Preferably, a rubber blanket 04 has a support plate, which is not specifically represented, and which is comparable to the packing 04, with an elastic layer arranged thereon. In an advantageous manner, the support plate does not have an elastic layer in the area of the beveled or angled ends 06, 07. This allows a reduced width b08 of the gap 08. However, if a larger gap 08 is acceptable, the elastic layer can also extend into the channel 03, or into the cylinder channel opening 08.

Figure 2:
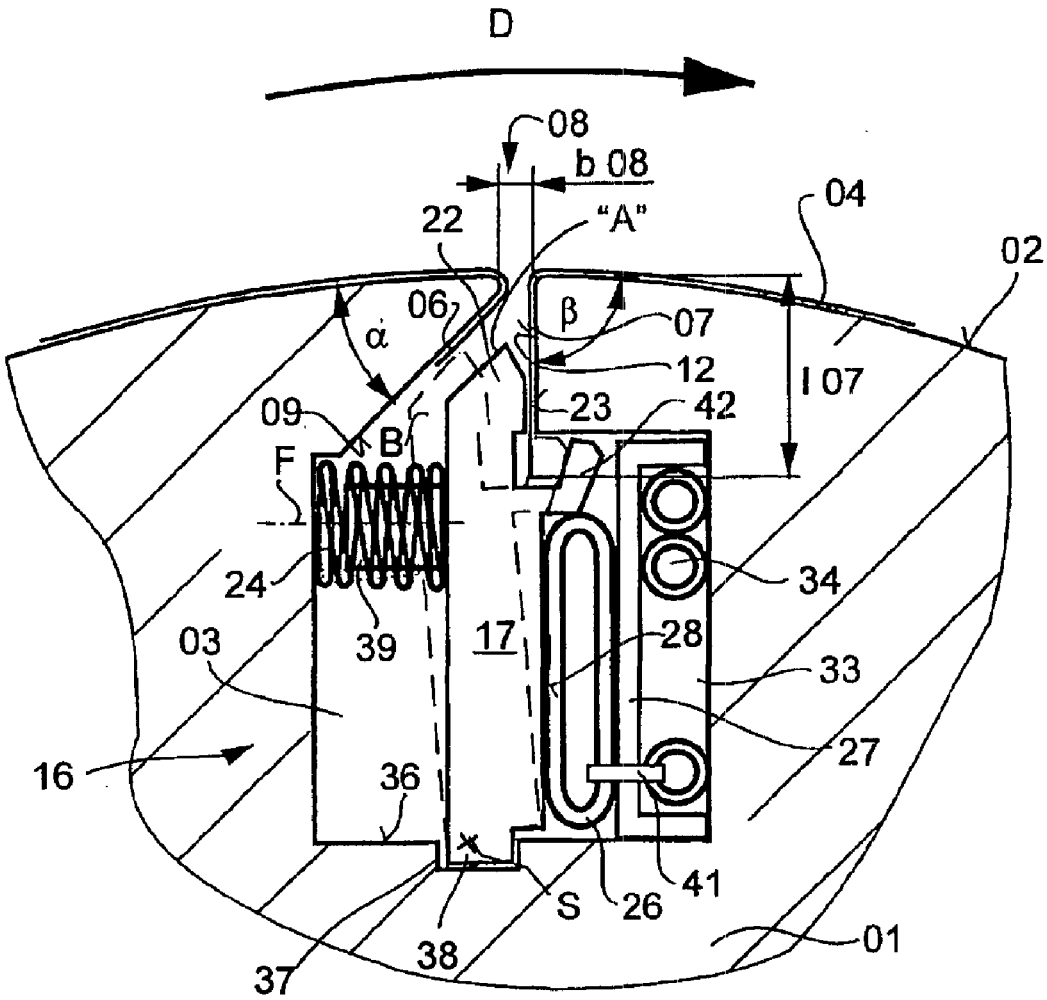
FIG. 2 is a cross-section through a second preferred embodiment of a device for securing a packing end and is also taken transversely to the cylinder axis.

In a second preferred embodiment of the device for securing a packing, as seen in FIG. 2, the channel 03 is not embodied as a round bore in the area of the packing trailing end securing device 16 located in the interior of the cylinder 01, but is generally rectangular. The cylinder channel 03, which widens toward the interior, is produced by wire eroding, for example coming from the direction of the cylinder surface area 02. In this case, the production of the cylinder and the channel is particularly cost-effective if the surplus material is removed from a solid wall area of either a cylinder 01 produced as a solid cylinder, or of a solid-walled exterior cylinder body, near the surface area 02 of the cylinder 01, previously produced with a circular outer profile, for forming the channel 03.

In an area of the cylinder channel 03 situated more closely to the cylinder center, a wall 36 of the cylinder channel 03 has a groove 37, in which a rib 38, or several bolts or pins 38 at the lower end of the lever 17, configured, for example as an axially extending sheet metal strip 17, are guided. The groove 37 and the pins, or the rib 38 are dimensioned, in respect to their size and shape, in such a way that the lever 17 is pivotably seated by its pins, or the rib 38, in the groove 37.

On the side of the lever 17 facing the packing trailing end 07, the reversibly deformable hollow body 26 is supported, on one side, on an abutment 27 in the form of a beveled sheet metal piece inserted into the channel 03, and, on the other side, on the lever 17. The pressure fluid delivery devices 34 for the pressure medium for the hollow body or bodies 26 are arranged in the hollow space 33 resulting between a wall 36 of the cylinder channel 03 near the packing trailing end 07 and the abutment 27 and are connected with the hollow body 26, or bodies, via one or several passages 41. The hollow body 26 can also be supported directly on the cylinder channel wall 36 if the delivery device or devices 34 is or are embodied as bores, not represented, in the cylinder body. On the side of the lever 17 opposite to the hollow body 26, there are provided one or several pins 39, on which the pressure spring 24 can be fastened. This pressure spring 24 works in cooperation with a wall 36 of the cylinder channel 03 which cylinder channel wall lies close to the packing leading end 06. In an advantageous configuration, the lever 17 has a shoulder 42, which acts, together with the radial outer wall 36 of the channel 03 to prevent the lever 17 from falling out of the cylinder channel 03. The lever 17 with its shoulder 42 and with the pin or pins 39 can be made in one piece.

The area of the wall 36 of the channel 03 acting together with the hollow body 26, and the wall 36 of the channel 03 acting together with the pressure spring 24, are each embodied to be straight in respect to a cross section perpendicular to the axis of rotation of the cylinder 01, and they are located opposite each other, and are approximately parallel.

Figure 3:
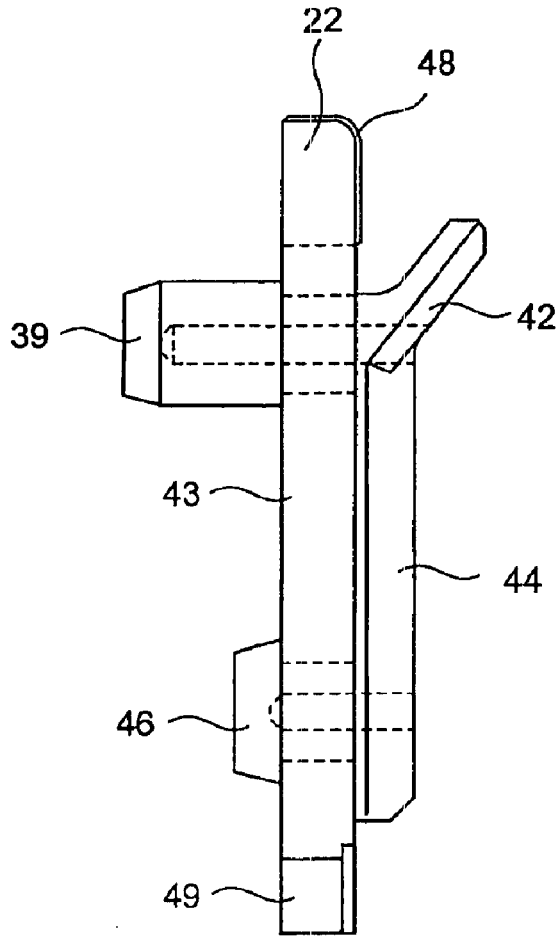
FIG. 3 is a side elevation view of an advantageous embodiment of a lever for use in the device for securing a packing in accordance with the present invention.
Figure 4:
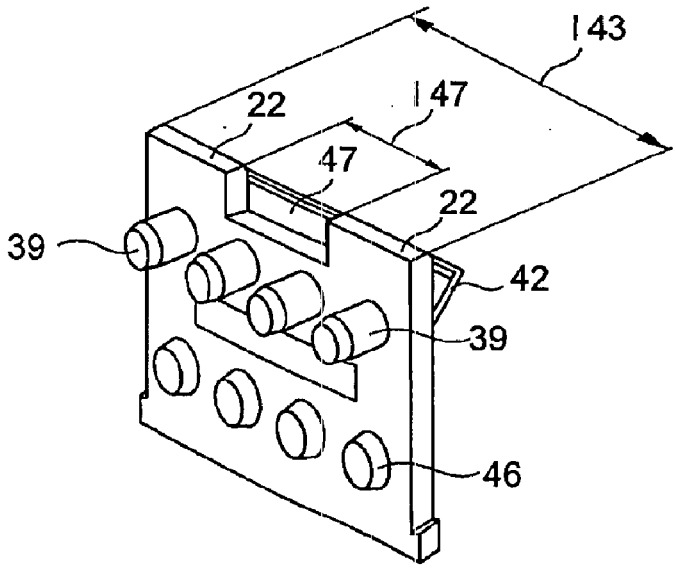
FIG. 4 is a perspective view of the lever of FIG. 3.

In a cost-effective and simultaneously rugged embodiment, as seen in FIG. 3, the lever 17 is made of a sheet metal piece 43, and in particular of a perforated sheet metal piece 43, on which, on the side facing toward the hollow body 26, a plate 44, for example a plastic plate 44, is arranged, which plastic plate has the shoulder 42, formed for example, in the shape of a bevel. On its side facing the perforated sheet metal piece 43, the plastic plate 44 has strips, for example, which extend through the perforations of the perforated sheet metal piece 43 and which can receive or form the pins 39 on the other side in the upper area. In the lower area of the sheet metal plate 43 these plastic strips can be thermally flattened following their mounting for fixing the plastic plate 44 in place. However, in a particularly cost-effective and rugged embodiment, the plastic plate 44 can also be cast in one piece with the perforated sheet metal piece 43 with the above-described pins 39, shoulder 42 and fastening 46. On its upper or face end 22, acting together with the packing trailing end 07, for example, the perforated sheet metal piece 43 has cutouts 47, as seen in FIG. 4, so that the piece 43 end 07 only acts together in sections with the trailing end 07. In particular, a length l43 of the perforated sheet metal piece 43 and a length l47 of the cutout 47 have been selected to be such that for each perforated sheet metal piece 43, the lever 17 acts, together with the packing trailing end 07, only in the area of two ends 22 of the lever 17 for preventing tilting or warping. For example, 35 mm<l43<50 mm, and 12 mm<l47<22 mm. In this embodiment, several such levers 17 are arranged next to each other in the channel 03 for each width of the packing 04, in order, for example, for preventing tilting and for easier removal capability. In the area of the free end 22 of the lever 17, which acts together with the packing trailing end 07, the perforated sheet metal piece 43 is advantageously provided with a coating 48 for increasing its sturdiness and/or its frictional resistance. To insure that two levers 17 arranged next to each other in the channel 03 do not get hooked together, a shoulder 49 can be arranged in the axial direction of the cylinder 01 on one or on both sides of the lower end of the sheet metal piece 43.

In a manner which is the same as that discussed previously in connection with the first preferred embodiment, the arrangement of several hollow bodies 24 with their several associated delivery devices 34, which is advantageous for double-wide, with up to four printing plates 04 next to each other, or triple-wide, with up to six printing plates 04 next to each other cylinders 01, is also advantageous for the embodiments of the second preferred embodiment in order to accomplish an easy change of the packings 04. In this case, the length of a lever 17 maximally corresponds to the width of a packing 04, if only one lever 17 for each packing is provided. This correspondingly applies for several levers 17 for each width of the packing 04. The packing trailing end securing devices 16 having the lever 17 and the pressure springs 24 can be arranged, for example, in a row next to each other for all four packings 04, or can also be arranged in several, so-called staggered channels 03, which are offset in the circumferential direction with respect to each other.

The particularly simple and cost-effective construction and handling of the devices for securing a packing, in accordance with the present invention, is advantageous in connection with the embodiment shown in FIG. 2, and particularly in accordance with FIGS. 3 and 4. For equipping the channel 03 with a securing device 16, it is merely necessary to laterally introduce the abutment 27 which, for example, already carries the delivery device or devices 34, the hollow body 26 and the lever 17, already equipped with the pressure spring or springs 24. If the cylinder body has non-represented openings for the supply of pressure medium, the introduction of an appropriate abutment 27 with delivery devices 34 can be omitted.

In a further embodiment of the present device, which is not specifically represented, the spring 24 is embodied as a leaf spring 24. It is also possible, in connection with special embodiments, to seat the one-armed lever 17 resiliently, for example on a torsion bar spring, also not represented. In this case an additional spring 24 can be omitted.

The set-up for installing or removing a packing 04 is performed in the following way by use of the device for securing a packing in accordance with the present invention.

If a packing 04 is to be secured to the cylinder 01, the reversibly deformable hollow body 26 initially remains relaxed, and the lever 17 remains in the clamping position A shown in solid lines in FIGS. 1 and 2 because of the force of the spring 24. The packing leading end 06 is suspended on the protrusion 11. By charging the hollow body 26 with compressed air, the lever 17 is placed against the packing leading end 06 and secures it against slippage in the securing position B. The packing 04 is now pulled onto the cylinder surface area 02 by rotating the cylinder 01 in the rotating direction D until the packing trailing beveled end 07, which has a length l 07, is pushed into the opening 08 of the channel 03. The hollow body 26 is now exhausted, so that the lever 17 is brought into the clamping position A by the spring 24 and frictionally maintains, depending on the embodiment, the packing trailing end 07 between the clamping face 23 and the channel wall 12, or the wall 18 of the base body 13. The release of a packing 04 takes place in the reverse order and direction of rotation. If several packings 04 are arranged one behind the other in the circumferential direction of the cylinder 01, the securement of the leading end 06 of the second packing 04, or of further packings 04, is omitted in the securing position B of the lever 17.

An exchange, or the maintenance of the device for securing can take place in a simple manner by pushing the individual base bodies 13, which are independent of each other, in the axial direction and thus out of the channel 03, without the removal of the entire cylinder 01 being necessary. In the preferred embodiments of the present invention, in accordance with FIG. 2 or FIGS. 3 and 4, the removal or installation is possible by a simple insertion or pushing out of the lever 17, which is provided with the spring 24 and the shoulder 42, from the direction of the front end of the cylinder.

While preferred embodiments of devices for securing a packing, in accordance with the present invention, have been set forth fully and completely hereinabove, it will be apparent to one of skill in the art that changes in, for example, the overall size of the cylinder, the specific type of rotary printing press in which it is used, and the like could be made without departing from the true spirit and scope of the present invention which is accordingly to be limited only by the appended claims.

What is claimed is:

1. A cylinder in combination with a device for securing at least one beveled leading end and at least one beveled trailing end of at least one flexible packing on the cylinder of a rotary printing press comprising:

at least one channel in the cylinder, said channel extending in an axial direction of the cylinder and having an opening extending to a circumferential surface of the cylinder;

a first channel wall extending at an acute angle to said cylinder surface, said first channel wall and said cylinder surface defining a packing leading end receiving protrusion;

a second channel wall engageable by said packing trailing end;

at least one packing trailing end securing device in said channel, said packing trailing end securing device including at least one single rigid lever pivotable about a pivot axis, which is stationary with respect to the cylinder;

a spring situated in said channel and engageable with said lever to place said lever in clamping engagement with the packing trailing end; and at least one base body in said channel, said base body having a wall, said single rigid lever being seated in an area of said wall located opposite said opening for pivotal movement about said pivot axis, said base body receiving said packing trailing end securing device.

2. The device of claim 1 wherein said acute angle is between 30° and 60°.

3. The device of claim 1 wherein said pivot axis is located in said base body wall.

4. The device of claim 1 wherein said spring is a pressure spring.

5. The device of claim 1 wherein said lever has a clamping face engageable with the packing trailing end, said pivot axis and said clamping face defining a line, said spring intersecting said line at least halfway along said line from said pivot axis to said clamping face.

6. The device of claim 1 wherein said second channel wall forms an angle of between 85° and 95° with said cylinder circumferential surface.

7. The device of claim 1 wherein the packing trailing end is beveled at an angle of approximately 90°.

8. The device of claim 1 further including a reversible deformable body chargeable with a medium under pressure and adapted to move said securing device out of clamping engagement with the packing trailing end.

9. The device of claim 8 wherein said base body is tube-shaped and has at least one aperture, said aperture facing the leading and trailing plate ends, said reversible deformable body being received in said base body.

10. The device of claim 8 wherein said base body has several of said securing devices arranged next to each other.

11. The device of claim 10 further including a delivery device for supplying said pressure medium to said actuating means, said delivery device being arranged in said at least one channel.

12. The device of claim 11 wherein said delivery device is arranged in said base body.

13. The device of claim 1 wherein said channel has a gap in an area of said circumferential surface of said cylinder, said gap having a width of less than 5 mm.

14. The device of claim 13 wherein said width is less than 3 mm.

15. The device of claim 1 further including a plurality of base bodies arranged axially adjacent each other, each of said base bodies having at least one of said packing trailing end securing devices.

16. The device of claim 1 wherein said rigid lever includes a packing trailing end clamping face, said packing trailing end clamping face acting with said second channel wall and frictionally engaging the packing trailing end.

17. The device of claim 1 wherein said rigid lever includes a packing trailing end clamping face, said base body being tube shaped, said clamping face engaging said wall of said base body and frictionally engaging the packing trailing end.

18. The device of claim 1 wherein said spring has a force direction extending by ±15° with respect to a line perpendicular to said second channel wall.

19. The device of claim 1 wherein said securing device is in a secured position in engagement with the packing trailing end during securement of the packing to the cylinder.

20. A cylinder in combination with a device for securing at least one beveled leading end and at least one beveled trailing end of at least one flexible packing on the cylinder of a rotary printing press comprising:

at least one channel in the cylinder, said at least one channel extending in an axial direction of the cylinder and having an opening extending to a circumferential surface of the cylinder;

a first channel wall extending at an acute angle to said cylinder surface, said first channel wall and said cylinder surface defining a packing leading end receiving protrusion;

a second channel wall engageable by said packing trailing end;

a packing trailing end securing device in said channel and including at least one single rigid lever pivotable about a pivot axis and clampingly engageable with said packing trailing end in a clamping position;

a spring in said channel and engageable with a wall of said channel and with said lever, said wall extending generally perpendicularly to said surface of said cylinder, said spring moving said lever to said clamping position;

at least one actuating means operable to release said lever from said clamping position, said actuating means being chargeable with a pressure medium, said actuating means being located in said channel; and a channel inner wall, said lever being pivotally supported by said channel inner wall for movement about said pivot axis.

21. The device of claim 20 wherein said channel widens in an interior of said cylinder and said channel inner wall is located in a widest position of said channel.

22. The device of claim 20 wherein said pivot axis is stationary with respect to said cylinder.

23. The device of claim 20 wherein said spring is a pressure spring.

24. The device of claim 20 wherein said lever has a clamping face engageable with the packing trailing end, said pivot axis and said clamping face defining a line, said spring intersecting said line at least halfway along said line from said pivot axis to said clamping face.

25. The device of claim 20 wherein said second channel wall forms an angle of between 85° and 95° with said cylinder circumferential surface.

26. The device of claim 20 wherein the packing trailing end is beveled at an angle of approximately 90°.

27. The device of claim 20 wherein said channel has a gap in an area of said circumferential surface of said cylinder, said gap having a width of less than 5 mm.

28. The device of claim 27 wherein said width is less than 3 mm.

29. The device of claim 20 wherein said actuating means is arranged between said lever and said channel wall.

30. The device of claim 29 wherein said spring is secured to said lever facing away from said actuating means.

31. The device of claim 29 further including a plurality of said levers and a plurality of said actuating means in said channel.

32. The device of claim 29 further including a delivery device for supplying said pressure medium to said actuating means, said delivery device being arranged in said at least one channel.

33. The device of claim 20 further including an abutment in said channel located intermediate said lever and said channel wall, said actuating means being located between said abutment and said lever.

34. The device of claim 20 wherein said spring is secured to said lever facing away from said actuating means.

35. The device of claim 20 further including a plurality of said levers and a plurality of said actuating means in said channel.

36. The device of claim 20 wherein said spring has a force direction extending by ±15° with respect to a line perpendicular to said second channel wall.

37. The device of claim 20 wherein said securing device is in a secured position in engagement with the packing trailing end during securement of the packing to the cylinder.

* * * * *

UNITED STATES PATENT AND TRADEMARK OFFICE

CERTIFICATE OF CORRECTION

PATENT NO. : 6,862,991 B2
DATED : March 8, 2005
INVENTOR(S) : Karl Robert Schafer It is certified that error appears in the above-identified patent and that said Letters Patent is hereby corrected as shown below:

Title page,
Item [73], Assignee, after "Assignee: Koenig & Bauer" change "Ajtuebgesekkscgaft" to -- Aktiengesellschaft --

Signed and Sealed this

Tenth Day of May, 2005

JON W. DUDAS
*Director of the United States Patent and Trademark Office*